US007187348B2

(12) United States Patent
Iwami et al.

(10) Patent No.: US 7,187,348 B2
(45) Date of Patent: Mar. 6, 2007

(54) DRIVING METHOD FOR PLASMA DISPLAY PANEL

(75) Inventors: Takashi Iwami, Yamanashi (JP); Shigeru Iwaoka, Yamanashi (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 211 days.

(21) Appl. No.: 10/183,393

(22) Filed: Jun. 28, 2002

(65) Prior Publication Data

US 2003/0006944 A1 Jan. 9, 2003

(30) Foreign Application Priority Data

Jul. 6, 2001 (JP) ..... 2001-205532

(51) Int. Cl.
*G09G 3/28* (2006.01)

(52) U.S. Cl. ..... 345/62; 345/63; 345/67; 315/169.4

(58) Field of Classification Search ..... 345/60–70, 345/204, 208–210; 315/169.1–169.4
See application file for complete search history.

(56) References Cited

U.S. PATENT DOCUMENTS 6,175,194 B1 * 1/2001 Saegusa et al. ..... 315/169.4
6,479,943 B2 * 11/2002 Shigeta et al. ..... 315/169.4
6,614,413 B2 * 9/2003 Tokunaga et al. ..... 345/63
6,630,796 B2 * 10/2003 Tokunaga et al. ..... 315/169.4
6,870,521 B2 * 3/2005 Iwami ..... 345/60

* cited by examiner

*Primary Examiner*—Lun-Yi Lao
(74) *Attorney, Agent, or Firm*—Sughrue Mion, PLLC

(57) ABSTRACT

A driving method for a plasma display panel realizes a high quality display at low power consumption while restraining a false contour. After a selective discharge for setting discharge cells to a light-on state or a light-off state is generated in one subfield of N subfields constituting each field, the selective discharge is generated again only in subfields placed at predetermined positions from the beginning of each field.

9 Claims, 11 Drawing Sheets

| CONVERSION TABLE FOR SECOND DATA CONVERSION CIRCUIT 34 | | | | | | | | | | | | | | | LIGHT EMISSION DRIVE PATTERN IN 1 FIELD | | | | | | | | | | | | | | VISUALLY SENSED LUMINANCE |
|---|---|---|---|---|---|---|---|---|---|---|---|---|---|---|---|---|---|---|---|---|---|---|---|---|---|---|---|---|---|
| PDs | GD | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | 1 | 2 | 3 | 4 | 5 | 6 | 7 | 8 | 9 | 10 | 11 | 12 | 13 | 14 | | | | | | | | | | | | | | | |
| 0000 | 1 | 1 | 1 | 0 | 1 | 0 | 1 | 0 | 1 | 0 | 1 | 0 | 1 | 0 | ● | ● | ● | | ● | | ● | | ● | | ● | | ● | | 0 |
| 0001 | 0 | 1 | 1 | 1 | 1 | 0 | 1 | 0 | 1 | 0 | 1 | 0 | 1 | 0 | ○ | ● | ● | ● | ● | | ● | | ● | | ● | | ● | | 1 |
| 0010 | 0 | 0 | 1 | 1 | 1 | 0 | 1 | 0 | 1 | 0 | 1 | 0 | 1 | 0 | ○ | ○ | ● | ● | ● | | ● | | ● | | ● | | ● | | 4 |
| 0011 | 0 | 0 | 0 | 1 | 1 | 1 | 1 | 0 | 1 | 0 | 1 | 0 | 1 | 0 | ○ | ○ | ○ | ● | ● | ● | ● | | ● | | ● | | ● | | 9 |
| 0100 | 0 | 0 | 0 | 0 | 1 | 1 | 1 | 0 | 1 | 0 | 1 | 0 | 1 | 0 | ○ | ○ | ○ | ○ | ● | ● | ● | | ● | | ● | | ● | | 17 |
| 0101 | 0 | 0 | 0 | 0 | 0 | 1 | 1 | 1 | 1 | 0 | 1 | 0 | 1 | 0 | ○ | ○ | ○ | ○ | ○ | ● | ● | ● | ● | | ● | | ● | | 27 |
| 0110 | 0 | 0 | 0 | 0 | 0 | 0 | 0 | 1 | 1 | 0 | 1 | 0 | 1 | 0 | ○ | ○ | ○ | ○ | ○ | ○ | ● | ● | ● | | ● | | ● | | 40 |
| 0111 | 0 | 0 | 0 | 0 | 0 | 0 | 0 | 1 | 1 | 1 | 1 | 0 | 1 | 0 | ○ | ○ | ○ | ○ | ○ | ○ | ○ | ● | ● | ● | ● | | ● | | 56 |
| 1000 | 0 | 0 | 0 | 0 | 0 | 0 | 0 | 0 | 0 | 1 | 1 | 0 | 1 | 0 | ○ | ○ | ○ | ○ | ○ | ○ | ○ | ○ | ● | ● | ● | | ● | | 75 |
| 1001 | 0 | 0 | 0 | 0 | 0 | 0 | 0 | 0 | 0 | 1 | 1 | 1 | 1 | 0 | ○ | ○ | ○ | ○ | ○ | ○ | ○ | ○ | ○ | ● | ● | ● | ● | | 97 |
| 1010 | 0 | 0 | 0 | 0 | 0 | 0 | 0 | 0 | 0 | 0 | 1 | 1 | 1 | 0 | ○ | ○ | ○ | ○ | ○ | ○ | ○ | ○ | ○ | ○ | ● | ● | ● | | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE: SELECTIVE ERASE DISCHARGE
WHITE CIRCLE: SUSTAIN DISCHARGE FOR LIGHT EMISSION

FIG. 2

| GRAYSCALE | LIGHT EMISSION DRIVE PATTERN IN 1 FIELD | | | | | | VISUALLY SENSED LUMINANCE |
|---|---|---|---|---|---|---|---|
| | SF 1 | SF 2 | SF 3 | SF 4 | SF 5 | SF 6 | |
| 1 | ● | ● | ● | ● | ● | ● | 0 |
| 2 | ○ | ● | ● | ● | ● | ● | 1 |
| 3 | ○ | ○ | ● | ● | ● | ● | 3 |
| 4 | ○ | ○ | ○ | ● | ● | ● | 7 |
| 5 | ○ | ○ | ○ | ○ | ● | ● | 15 |
| 6 | ○ | ○ | ○ | ○ | ○ | ● | 31 |
| 7 | ○ | ○ | ○ | ○ | ○ | ○ | 63 |

○ LIGHT EMISSION

● LIGHT-OFF

FIG. 6

| CONVERSION TABLE FOR SECOND DATA CONVERSION CIRCUIT 34 | | | | | | | | | | | | | | | LIGHT EMISSION DRIVE PATTERN IN 1 FIELD | | | | | | | | | | | | | | VISUALLY SENSED LUMINANCE |
|---|---|---|---|---|---|---|---|---|---|---|---|---|---|---|---|---|---|---|---|---|---|---|---|---|---|---|---|---|---|
| PDs | GD | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | 1 | 2 | 3 | 4 | 5 | 6 | 7 | 8 | 9 | 10 | 11 | 12 | 13 | 14 | | | | | | | | | | | | | | | |
| 0000 | 1 | 1 | 1 | 0 | 1 | 0 | 1 | 0 | 1 | 0 | 1 | 0 | 1 | 0 | ● | ● | ● | | ● | | ● | | ● | | ● | | ● | | 0 |
| 0001 | 0 | 1 | 1 | 1 | 1 | 0 | 1 | 0 | 1 | 0 | 1 | 0 | 1 | 0 | ○ | ● | ● | ● | ● | | ● | | ● | | ● | | ● | | 1 |
| 0010 | 0 | 0 | 1 | 1 | 1 | 0 | 1 | 0 | 1 | 0 | 1 | 0 | 1 | 0 | ○ | ○ | ● | ● | ● | | ● | | ● | | ● | | ● | | 4 |
| 0011 | 0 | 0 | 0 | 1 | 1 | 1 | 1 | 0 | 1 | 0 | 1 | 0 | 1 | 0 | ○ | ○ | ○ | ● | ● | ● | ● | | ● | | ● | | ● | | 9 |
| 0100 | 0 | 0 | 0 | 0 | 1 | 1 | 1 | 0 | 1 | 0 | 1 | 0 | 1 | 0 | ○ | ○ | ○ | ○ | ● | ● | ● | | ● | | ● | | ● | | 17 |
| 0101 | 0 | 0 | 0 | 0 | 0 | 1 | 1 | 1 | 1 | 0 | 1 | 0 | 1 | 0 | ○ | ○ | ○ | ○ | ○ | ● | ● | ● | ● | | ● | | ● | | 27 |
| 0110 | 0 | 0 | 0 | 0 | 0 | 0 | 0 | 1 | 1 | 0 | 1 | 0 | 1 | 0 | ○ | ○ | ○ | ○ | ○ | ○ | ● | ● | ● | | ● | | ● | | 40 |
| 0111 | 0 | 0 | 0 | 0 | 0 | 0 | 0 | 1 | 1 | 1 | 1 | 0 | 1 | 0 | ○ | ○ | ○ | ○ | ○ | ○ | ○ | ● | ● | ● | ● | | ● | | 56 |
| 1000 | 0 | 0 | 0 | 0 | 0 | 0 | 0 | 0 | 0 | 1 | 1 | 0 | 1 | 0 | ○ | ○ | ○ | ○ | ○ | ○ | ○ | ○ | ● | ● | ● | | ● | | 75 |
| 1001 | 0 | 0 | 0 | 0 | 0 | 0 | 0 | 0 | 0 | 1 | 1 | 1 | 1 | 0 | ○ | ○ | ○ | ○ | ○ | ○ | ○ | ○ | ○ | ● | ● | ● | ● | | 97 |
| 1010 | 0 | 0 | 0 | 0 | 0 | 0 | 0 | 0 | 0 | 0 | 1 | 1 | 1 | 0 | ○ | ○ | ○ | ○ | ○ | ○ | ○ | ○ | ○ | ○ | ● | ● | ● | | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE: SELECTIVE ERASE DISCHARGE
WHITE CIRCLE: SUSTAIN DISCHARGE FOR LIGHT EMISSION

FIG. 9

| CONVERSION TABLE FOR SECOND DATA CONVERSION CIRCUIT 34 | | | | | | | | | | | | | | | LIGHT EMISSION DRIVE PATTERN IN 1 FIELD | | | | | | | | | | | | | | VISUALLY SENSED LUMINANCE |
|---|---|---|---|---|---|---|---|---|---|---|---|---|---|---|---|---|---|---|---|---|---|---|---|---|---|---|---|---|---|
| PDs | GD | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | 1 | 2 | 3 | 4 | 5 | 6 | 7 | 8 | 9 | 10 | 11 | 12 | 13 | 14 | | | | | | | | | | | | | | | |
| 0000 | 1 | 1 | 1 | 1 | 0 | 1 | 0 | 1 | 0 | 1 | 0 | 1 | 0 | 1 | ● | ● | ● | ● | | ● | | ● | | ● | | ● | | ● | 0 |
| 0001 | 0 | 1 | 1 | 1 | 0 | 1 | 0 | 1 | 0 | 1 | 0 | 1 | 0 | 1 | ○ | ● | ● | ● | | ● | | ● | | ● | | ● | | ● | 1 |
| 0010 | 0 | 0 | 1 | 1 | 1 | 1 | 0 | 1 | 0 | 1 | 0 | 1 | 0 | 1 | ○ | ○ | ● | ● | ● | ● | | ● | | ● | | ● | | ● | 4 |
| 0011 | 0 | 0 | 0 | 1 | 1 | 1 | 0 | 1 | 0 | 1 | 0 | 1 | 0 | 1 | ○ | ○ | ○ | ● | ● | ● | | ● | | ● | | ● | | ● | 9 |
| 0100 | 0 | 0 | 0 | 0 | 1 | 1 | 1 | 1 | 0 | 1 | 0 | 1 | 0 | 1 | ○ | ○ | ○ | ○ | ● | ● | ● | ● | | ● | | ● | | ● | 17 |
| 0101 | 0 | 0 | 0 | 0 | 0 | 1 | 1 | 1 | 0 | 1 | 0 | 1 | 0 | 1 | ○ | ○ | ○ | ○ | ○ | ● | ● | ● | | ● | | ● | | ● | 27 |
| 0110 | 0 | 0 | 0 | 0 | 0 | 0 | 1 | 1 | 1 | 1 | 0 | 1 | 0 | 1 | ○ | ○ | ○ | ○ | ○ | ○ | ● | ● | ● | ● | | ● | | ● | 40 |
| 0111 | 0 | 0 | 0 | 0 | 0 | 0 | 0 | 1 | 1 | 1 | 0 | 1 | 0 | 1 | ○ | ○ | ○ | ○ | ○ | ○ | ○ | ● | ● | ● | | ● | | ● | 56 |
| 1000 | 0 | 0 | 0 | 0 | 0 | 0 | 0 | 0 | 1 | 1 | 1 | 1 | 0 | 1 | ○ | ○ | ○ | ○ | ○ | ○ | ○ | ○ | ● | ● | ● | ● | | ● | 75 |
| 1001 | 0 | 0 | 0 | 0 | 0 | 0 | 0 | 0 | 0 | 1 | 1 | 1 | 0 | 1 | ○ | ○ | ○ | ○ | ○ | ○ | ○ | ○ | ○ | ● | ● | ● | | ● | 97 |
| 1010 | 0 | 0 | 0 | 0 | 0 | 0 | 0 | 0 | 0 | 0 | 1 | 1 | 1 | 1 | ○ | ○ | ○ | ○ | ○ | ○ | ○ | ○ | ○ | ○ | ● | ● | ● | ● | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE: SELECTIVE ERASE DISCHARGE
WHITE CIRCLE: SUSTAIN DISCHARGE FOR LIGHT EMISSION

FIG. 10

| CONVERSION TABLE FOR SECOND DATA CONVERSION CIRCUIT 34 | | | | | | | | | | | | | | | LIGHT EMISSION DRIVE PATTERN IN 1 FIELD | | | | | | | | | | | | | | VISUALLY SENSED LUMINANCE |
|---|---|---|---|---|---|---|---|---|---|---|---|---|---|---|---|---|---|---|---|---|---|---|---|---|---|---|---|---|---|
| PDs | GD | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | 1 | 2 | 3 | 4 | 5 | 6 | 7 | 8 | 9 | 10 | 11 | 12 | 13 | 14 | | | | | | | | | | | | | | | |
| 0000 | 1 | 1 | 1 | 0 | 1 | 0 | 1 | 1 | 0 | 1 | 1 | 0 | 1 | 1 | ● | ● | ● | | ● | | ● | ● | | ● | ● | | ● | ● | 0 |
| 0001 | 0 | 1 | 1 | 1 | 1 | 0 | 1 | 1 | 0 | 1 | 1 | 0 | 1 | 1 | ○ | ● | ● | ● | ● | | ● | ● | | ● | ● | | ● | ● | 1 |
| 0010 | 0 | 0 | 1 | 1 | 1 | 0 | 1 | 1 | 0 | 1 | 1 | 0 | 1 | 1 | ○ | ○ | ● | ● | ● | | ● | ● | | ● | ● | | ● | ● | 4 |
| 0011 | 0 | 0 | 0 | 1 | 1 | 1 | 1 | 1 | 0 | 1 | 1 | 0 | 1 | 1 | ○ | ○ | ○ | ● | ● | ● | ● | ● | | ● | ● | | ● | ● | 9 |
| 0100 | 0 | 0 | 0 | 0 | 1 | 1 | 1 | 1 | 0 | 1 | 1 | 0 | 1 | 1 | ○ | ○ | ○ | ○ | ● | ● | ● | ● | | ● | ● | | ● | ● | 17 |
| 0101 | 0 | 0 | 0 | 0 | 0 | 1 | 1 | 1 | 0 | 1 | 1 | 0 | 1 | 1 | ○ | ○ | ○ | ○ | ○ | ● | ● | ● | | ● | ● | | ● | ● | 27 |
| 0110 | 0 | 0 | 0 | 0 | 0 | 0 | 1 | 1 | 1 | 1 | 1 | 0 | 1 | 1 | ○ | ○ | ○ | ○ | ○ | ○ | ● | ● | ● | ● | ● | | ● | ● | 40 |
| 0111 | 0 | 0 | 0 | 0 | 0 | 0 | 0 | 1 | 1 | 1 | 1 | 0 | 1 | 1 | ○ | ○ | ○ | ○ | ○ | ○ | ○ | ● | ● | ● | ● | | ● | ● | 56 |
| 1000 | 0 | 0 | 0 | 0 | 0 | 0 | 0 | 0 | 1 | 1 | 1 | 0 | 1 | 1 | ○ | ○ | ○ | ○ | ○ | ○ | ○ | ○ | ● | ● | ● | | ● | ● | 75 |
| 1001 | 0 | 0 | 0 | 0 | 0 | 0 | 0 | 0 | 0 | 1 | 1 | 1 | 1 | 1 | ○ | ○ | ○ | ○ | ○ | ○ | ○ | ○ | ○ | ● | ● | ● | ● | ● | 97 |
| 1010 | 0 | 0 | 0 | 0 | 0 | 0 | 0 | 0 | 0 | 0 | 1 | 1 | 1 | 1 | ○ | ○ | ○ | ○ | ○ | ○ | ○ | ○ | ○ | ○ | ● | ● | ● | ● | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE: SELECTIVE ERASE DISCHARGE
WHITE CIRCLE: SUSTAIN DISCHARGE FOR LIGHT EMISSION

FIG. 11

| CONVERSION TABLE FOR SECOND DATA CONVERSION CIRCUIT 34 | | | | | | | | | | | | | | | LIGHT EMISSION DRIVE PATTERN IN 1 FIELD | | | | | | | | | | | | | | VISUALLY SENSED LUMINANCE |
|---|---|---|---|---|---|---|---|---|---|---|---|---|---|---|---|---|---|---|---|---|---|---|---|---|---|---|---|---|---|
| PDs | GD | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | 1 | 2 | 3 | 4 | 5 | 6 | 7 | 8 | 9 | 10 | 11 | 12 | 13 | 14 | | | | | | | | | | | | | | | |
| 0000 | 1 | 1 | 1 | 0 | 1 | 0 | 0 | 1 | 0 | 0 | 1 | 0 | 0 | 1 | ● | ● | ● | | ● | | | ● | | | ● | | | ● | 0 |
| 0001 | 0 | 1 | 1 | 1 | 1 | 0 | 0 | 1 | 0 | 0 | 1 | 0 | 0 | 1 | ○ | ● | ● | ● | ● | | | ● | | | ● | | | ● | 1 |
| 0010 | 0 | 0 | 1 | 1 | 1 | 0 | 0 | 1 | 0 | 0 | 1 | 0 | 0 | 1 | ○ | ○ | ● | ● | ● | | | ● | | | ● | | | ● | 4 |
| 0011 | 0 | 0 | 0 | 1 | 1 | 1 | 0 | 1 | 0 | 0 | 1 | 0 | 0 | 1 | ○ | ○ | ○ | ● | ● | ● | | ● | | | ● | | | ● | 9 |
| 0100 | 0 | 0 | 0 | 0 | 1 | 1 | 1 | 1 | 0 | 0 | 1 | 0 | 0 | 1 | ○ | ○ | ○ | ○ | ● | ● | ● | ● | | | ● | | | ● | 17 |
| 0101 | 0 | 0 | 0 | 0 | 0 | 1 | 1 | 1 | 0 | 0 | 1 | 0 | 0 | 1 | ○ | ○ | ○ | ○ | ○ | ● | ● | ● | | | ● | | | ● | 27 |
| 0110 | 0 | 0 | 0 | 0 | 0 | 0 | 1 | 1 | 1 | 0 | 1 | 0 | 0 | 1 | ○ | ○ | ○ | ○ | ○ | ○ | ● | ● | ● | | ● | | | ● | 40 |
| 0111 | 0 | 0 | 0 | 0 | 0 | 0 | 0 | 1 | 1 | 1 | 1 | 0 | 0 | 1 | ○ | ○ | ○ | ○ | ○ | ○ | ○ | ● | ● | ● | ● | | | ● | 56 |
| 1000 | 0 | 0 | 0 | 0 | 0 | 0 | 0 | 0 | 1 | 1 | 1 | 0 | 0 | 1 | ○ | ○ | ○ | ○ | ○ | ○ | ○ | ○ | ● | ● | ● | | | ● | 75 |
| 1001 | 0 | 0 | 0 | 0 | 0 | 0 | 0 | 0 | 0 | 1 | 1 | 1 | 0 | 1 | ○ | ○ | ○ | ○ | ○ | ○ | ○ | ○ | ○ | ● | ● | ● | | ● | 97 |
| 1010 | 0 | 0 | 0 | 0 | 0 | 0 | 0 | 0 | 0 | 0 | 1 | 1 | 1 | 1 | ○ | ○ | ○ | ○ | ○ | ○ | ○ | ○ | ○ | ○ | ● | ● | ● | ● | 122 |
| 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE: SELECTIVE ERASE DISCHARGE
WHITE CIRCLE: SUSTAIN DISCHARGE FOR LIGHT EMISSION

DRIVING METHOD FOR PLASMA DISPLAY PANEL

BACKGROUND OF THE INVENTION

1. Field of the Invention

The present invention relates to a driving method for a matrix display type plasma display panel.

2. Description of Related Art

Nowadays, plasma display panel (referred to as PDP hereafter) having a plurality of discharge cells serving as pixels and arranged as a matrix is drawing attention as a two dimensional image display panel. The individual discharge cells are selectively discharged according to pixel data for the individual pixels based on a video signal, and a light emission caused by the discharge forms a display image on a screen in the PDP. In this operation, because each of the discharge cells use the discharge phenomenon to emit light, the discharge cells have only two states comprising a state for emitting light at the highest luminance, and a state for not emitting light. Namely, only luminance levels corresponding to two grayscales can be expressed. Thus, a grayscale drive based on a subfield method is conducted to provide an intermediate luminance display according to an input video signal on the PDP comprising the discharge cells.

The grayscale drive based on the subfield method a display period of each field is divided into N subfields, a light emission period (a number of light emissions) corresponding to a weight of each bit of the pixel data (N bits) is assigned to each subfield, and conducts a light emission drive for the PDP.

For example, when one field is divided into the six subfields SF1 to SF6 shown in FIG. 1, the following light emission periods are assigned to the subfields respectively.

SF1: 1
SF2: 2
SF3: 4
SF4: 8
SF5: 16
SF6: 32

Then, the light emission is conducted selectively in each of the subfields SF1 to SF6 according to the luminance levels represented by the input video signal. The intermediate luminance is visually sensed corresponding to the sum of the light emission periods through one field (SF1 to SF6). For example, when the discharge cell emits light only in SF6 of the subfields SF1 to SF6, the discharge cell emits light only for a period corresponding to "32" in one field, and an intermediate luminance corresponding to "32" is visually sensed. On the other hand, when the discharge cell emits light in the subfields SF1 to SF5 except for SF6, the discharge cell emits light in a period corresponding to "1"+"2"+"4"+"8"+"16"="31", and an intermediate luminance corresponding to "31" is visually sensed.

With these six subfields, there are 64 possible ways for combining the subfields to emit light, and the subfields not to emit light (light emission patterns). With these 64 ways of the light emission patterns, there are 64 ways of the sums of light emission periods through one field, and it is possible to express intermediate luminance corresponding to 64 grayscales.

As shown in FIG. 1, the relationships between light emission period and light-off period are inverted to each other for a discharge cell $G_{31}$ corresponding to a pixel for representing luminance "32", and a discharge cell $G_{32}$ corresponding to a pixel for representing luminance "31" in a period of one field, for example. When one is viewing the screen of the PDP, if one sees the discharge cell $G_{32}$ in a period from SF1 to SF5, and then moves the line of sight to the discharge cell $G_{31}$, one continuously sees only the light-off periods of both of the them as shown as a broken line in FIG. 1. As a result, a dark line is visually sensed on a boundary between them as a false contour, and a problem of degrading the image quality occurs.

In view of the forgoing, it was devised to use only the seven light emission patterns shown in FIG. 2 out of the 64 light emission patterns described above for driving the PDP. With these light emission patterns, except for expressing a luminance of "0" as shown in FIG. 2, the discharge cell always emits light continuously from the first subfield SF1. Once the discharge cell switches to the light-off state, the discharge cell does not emit light in the following subfields thereafter through one field.

Thus, because the seven light emission patterns shown in FIG. 2 do not include light emission patterns whose relationships between light emission period and light-off period are inversed to each other for a period of the one filed, the false contour described above is not generated.

However, there is a problem that discharge should be caused even when the discharge cell is set to the light-off state as shown as black circles in FIG. 2, and the power consumption becomes large in driving the PDP.

OBJECT AND SUMMARY OF THE INVENTION

The present invention is devised to solve the problem above, and an object thereof is to provide a driving method for a plasma display panel for realizing a high quality image display while controlling a false contour with low power consumption.

A driving method of the present invention is devised for a plasma display panel having discharge cells for serving as pixels formed at intersections between a plurality of row electrodes corresponding to display lines, and a plurality of column electrodes arranged across the row electrodes. This method features that each of the fields of a video signal is constituted by N subfields, and the plasma display panel is driven subfield by subfield. Each of the subfields comprises an address period for generating a selective discharge in each of the discharge cells to set the discharge cells to either one of a light-on discharge cell state and a light-off discharge cell state, and a light emission sustain period for repeating a sustain discharge only in the discharge cells in the light-on discharge cell state for a number of times corresponding to a weight of the subfield. This method is characterized in that the selective discharge is generated in the address period of one subfield of the N subfields, and then the selective discharge is generated again only in the address period of subfields which are at predetermined positions from the start of the fields.

BRIEF DESCRIPTION OF THE DRAWINGS

FIG. 2 is a drawing for showing one example of a light emission pattern for preventing the false contour;

FIG. 6 is a drawing for showing a relationship between a conversion table of a second data conversion circuit 34 in the data conversion circuit 30 shown in FIG. 4, and a light emission drive pattern based on pixel drive data GD obtained from the conversion with this conversion table;

FIG. 9 is a drawing for showing a conversion table used in the second data conversion circuit 34, and a light emission drive pattern when a selective erase discharge is generated only in odd subfields for erasing wall charge formed again;

FIG. 10 is a drawing for showing a conversion table used in the second data conversion circuit 34, and a light emission drive pattern when the selective erase discharge is repeatedly generated in successive two subfields for erasing the wall charge formed again; and FIG. 11 is a drawing for showing a conversion table used in the second data conversion circuit 34, and a light emission drive pattern when the selective erase discharge is repeatedly generated in every three subfields for erasing wall charge generated again.

DETAILED DESCRIPTION OF THE PREFERRED EMBODIMENTS

Figure 1:
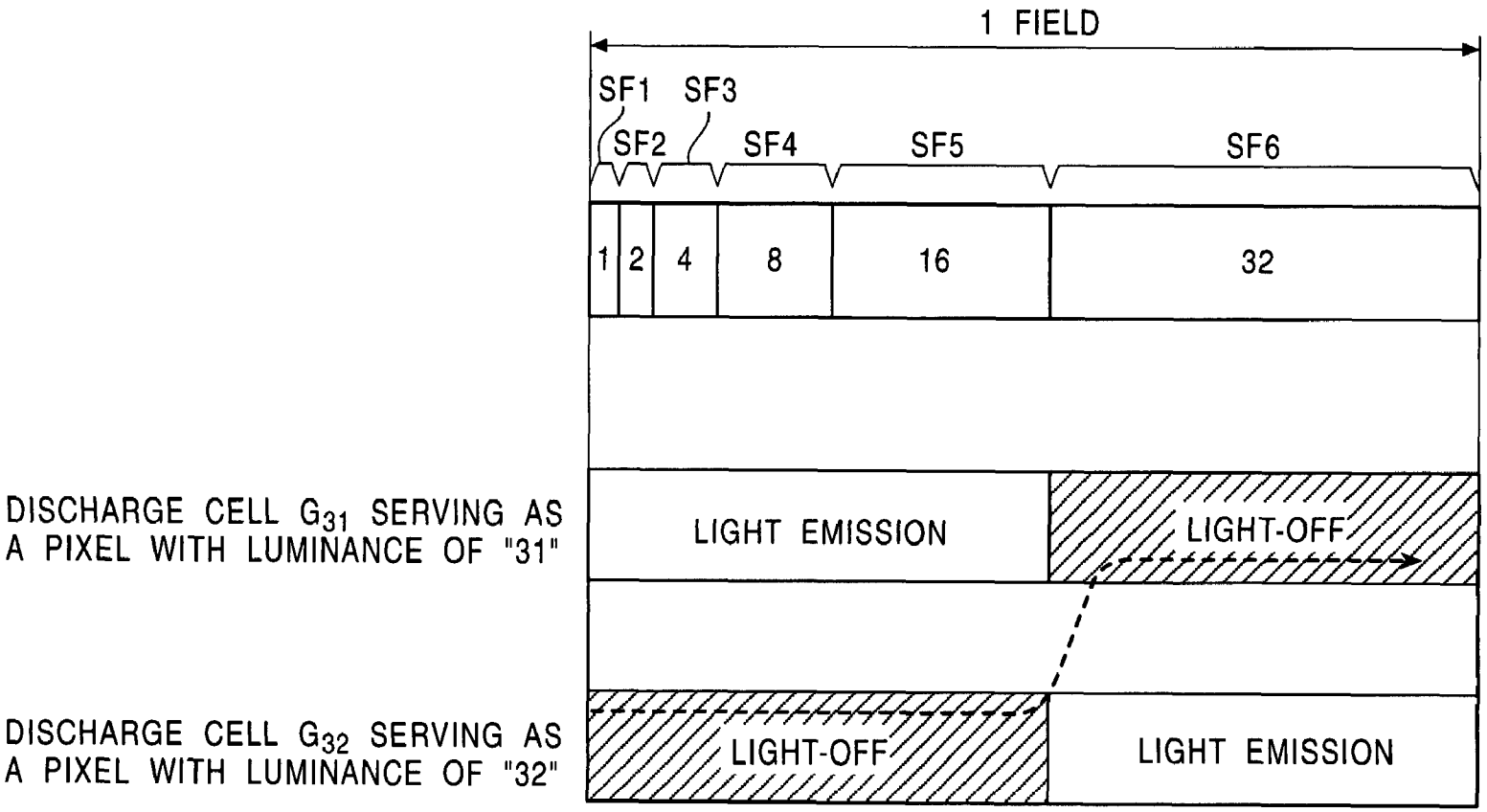
FIG. 1 is a drawing for describing a conventional light emission drive format when 64-level grayscale display is provided based on a subfield method, and a generation principle of a false contour.

The embodiments of the present invention will be described below while referring to the drawings.

Figure 3:
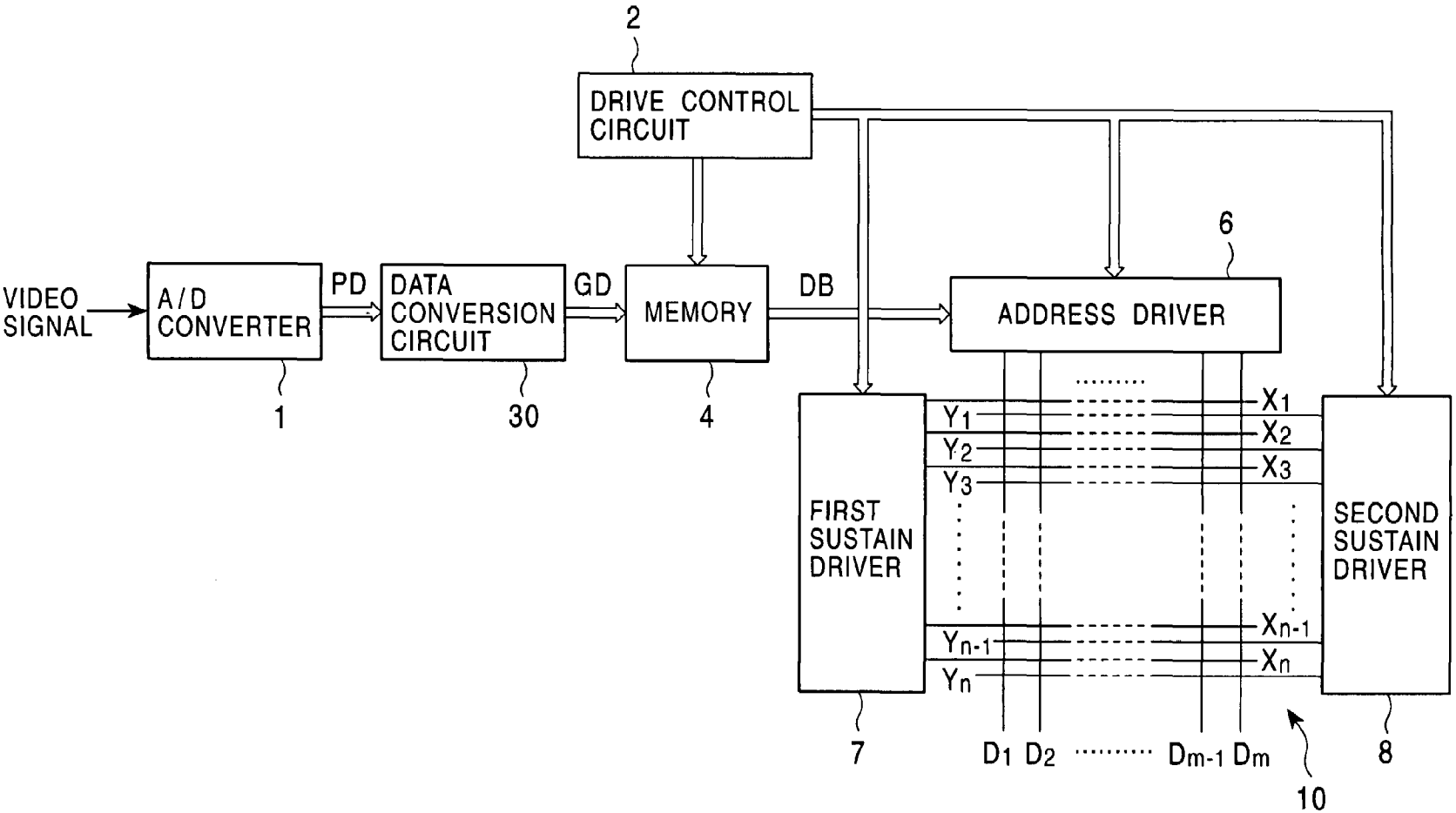
FIG. 3 is a drawing for schematically showing the structure of a plasma display device for driving a plasma display panel based on a driving method of the present invention.

FIG. 3 is a drawing for showing an overview constitution of a plasma display device for driving a plasma display panel for a grayscale representation based on a driving method of the present invention.

This plasma display device comprises a driver unit including an A/D converter 1, a drive control circuit 2, a memory 4, an address driver 6, a first sustain driver 7, a second sustain driver 8, and a data conversion circuit 30, and a PDP 10 as a plasma display panel.

The PDP 10 is provided with m column electrodes $D_1$ to $D_m$ and n row electrodes $X_1$ to $X_n$ and n row electrodes $Y_1$ to $Y_n$ respectively arranged across the column electrodes D. These row electrodes $X_1$ to $X_n$, and $Y_1$ to $Y_n$ are respectively combined as pairs of row electrodes Xi ($1 \leqq i \leqq n$) and Yi ($1 \leqq i \leqq n$) for serving as a first display line to an nth display line in the PDP 10. A discharge space in which discharge gas is filled is formed between the column electrode D and the row electrodes X and Y, and a discharge cell serving as a pixel is formed at each intersection between a pair of the row electrodes and the column electrode including the discharge space.

The A/D converter 1 samples an analog input video signal, converts this signal into 8-bit pixel data PD corresponding to each of the pixels, and supplies the data conversion circuit 30 with the pixel data PD.

Figure 4:
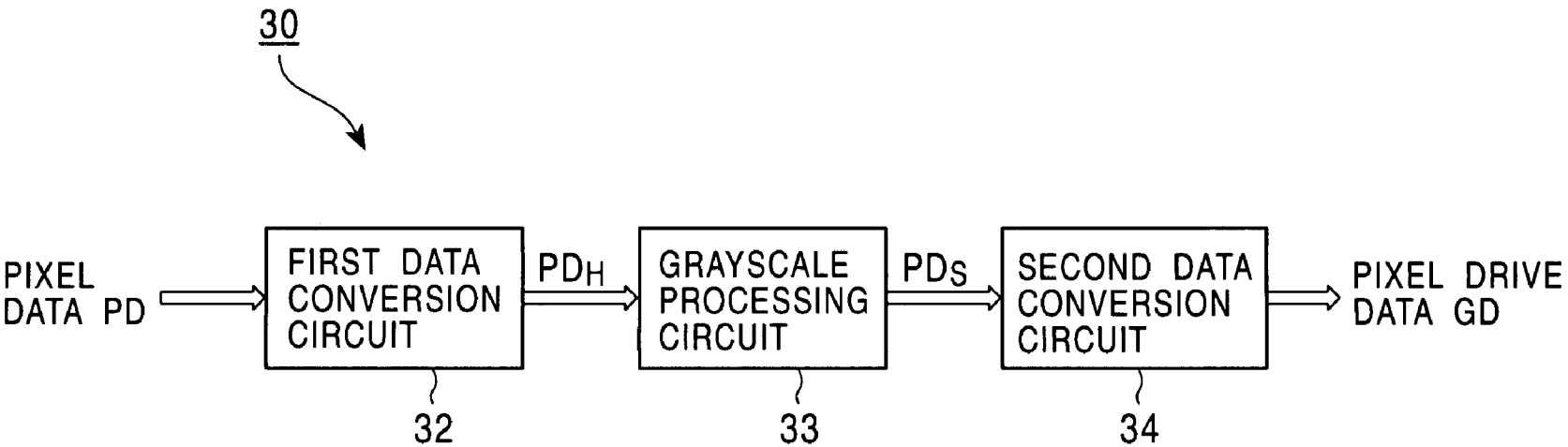
FIG. 4 is a drawing for showing an internal constitution of a data conversion circuit 30 in the plasma display device shown in FIG. 3.

FIG. 4 is a drawing for showing an internal constitution of the data conversion circuit 30.

Figure 5:
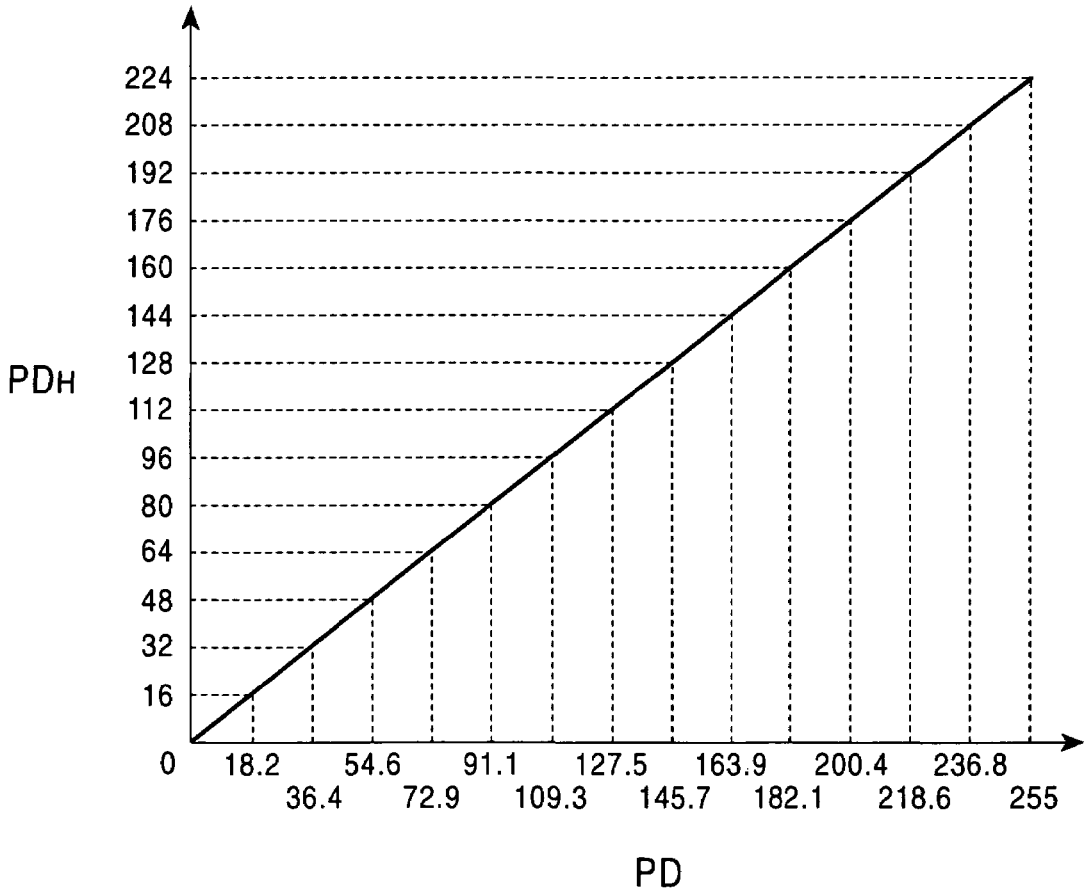
FIG. 5 is a drawing for showing a data conversion characteristic of a first data conversion circuit 32 in the data conversion circuit 30 shown in FIG. 4.

A first data conversion circuit 32 converts the pixel data PD which express "0" to "255" in eight bits into luminance-converted pixel data $PD_H$ which express "0" to "224" in eight bits based on a conversion characteristic shown in FIG. 5, and supplies a grayscale processing circuit 33 with them in FIG. 4. This data conversion by the first data conversion circuit 32 restrains a luminance saturation, and a generation of flatness (namely a distortion in the grayscale) in the display characteristic when a displayed grayscale level does not exists on a bit boundary during grayscale processing by the grayscale processing circuit 33 described later.

The grayscale processing circuit 33 applies error diffusion processing and dither processing to the luminance-converted pixel data $PD_H$ in eight bits to generate grayscale pixel data $PD_S$ in reduced bit number of four bits while the number of the current grayscale level is maintained. For example, first, it is assumed that the upper six bits of the luminance-converted data $PD_H$ are display data, and the remaining lower two bits are error data in the error diffusion processing. Then, the error data in the luminance-converted pixel data $PD_H$ are weighed corresponding to the positions of neighboring pixels and added to these neighboring pixels to reflect on their display data. With this operation, the neighboring pixels virtually express the luminance corresponding to the lower two bits of the original pixel, and the display data in six bits smaller than eight bits realize a grayscale representation equivalent to the pixel data in eight bits. The dither processing is applied to the six-bit error-diffused pixel data. In the dither processing, a plurality of pixels neighboring to one another are assumed as one pixel unit, dither coefficients having values different from one another are respectively assigned and added to the error-diffused pixel data corresponding to each pixel in this one pixel unit, and dither-added pixel data are obtained. With this addition of the dither coefficients, when the one pixel unit is viewed, only the upper four bits of the dither added-pixel data can provide luminance equivalent to one expressed in eight bits. The grayscale processing circuit 33 supplies a second data conversion circuit 34 with the upper four bits of the dither-added pixel data as grayscale pixel data $PD_S$.

The second data conversion circuit 34 converts the four-bit grayscale pixel data $PD_S$ into 14-bit pixel drive data GD based on a conversion table shown in FIG. 6, and supplies the memory 4 with the converted data.

The memory 4 sequentially writes the 14-bit pixel drive data GD based on a write signal supplied from the drive control circuit 2. When a write for one screen (n lines and m columns) is completed, the memory 4 reads the written data based on a read signal supplied from the drive control circuit 2 as described below.

First, in the memory 4 the written pixel drive data $GD_{11}$ to $GD_{nm}$ for one screen are treated as pixel drive data bits DB1 to DB14 divided into individual bits (first bit to 14th bit).

Namely, the memory 4 interprets as follows:

$DB1_{11}$ to $DB1_{nm}$: First bits of $GD_{11}$ to $GD_{nm}$
$DB2_{11}$ to $DB2_{nm}$: Second bits of $GD_{11}$ to $GD_{nm}$
$DB3_{11}$ to $DB3_{nm}$: Third bits of $GD_{11}$ to $GD_{nm}$
$DB4_{11}$ to $DB4_{nm}$: Fourth bits of $GD_{11}$ to $GD_{nm}$
$DB5_{11}$ to $DB5_{nm}$: Fifth bits of $GD_{11}$ to $GD_{nm}$
$DB6_{11}$ to $DB6_{nm}$: Sixth bits of $GD_{11}$ to $GD_{nm}$
$DB7_{11}$ to $DB7_{nm}$: Seventh bits of $GD_{11}$ to $GD_{nm}$
$DB8_{11}$ to $DB8_{nm}$: Eighth bits of $GD_{11}$ to $GD_{nm}$
$DB9_{11}$ to $DB9_{nm}$: Ninth bits of $GD_{11}$ to $GD_{nm}$
$DB10_{11}$ to $DB10_{nm}$: Tenth bits of $GD_{11}$ to $GD_{nm}$
$DB11_{11}$ to $DB11_{nm}$: Eleventh bits of $GD_{11}$ to $GD_{nm}$
$DB12_{11}$ to $DB12_{nm}$: Twelfth bits of $GD_{11}$ to $GD_{nm}$
$DB13_{11}$ to $DB13_{nm}$: Thirteenth bits of $GD_{11}$ to $GD_{nm}$
$DB14_{11}$ to $DB14_{nm}$: Fourteenth bits of $GD_{11}$ to $GD_{nm}$ The memory 4 reads the pixel drive data bits $DB1_{11}$ to $DB1_{nm}$ display line by display line in an address period $W_C$ in a subfield SF1 described later, and supplies the address driver 6 with these data bits. Then, the memory 4 reads the pixel drive data bits $DB2_{11}$ to $DB2_{nm}$ display line by display line in the address period $W_C$ in a subfield SF2 described later, and supplies the address driver 6 with these data bits. In the same way, the memory 4 reads the pixel drive data bits DB3 to DB14 display line by display line in the address period $W_c$ in subfields SF3 to SF14 described later, and supplies the address driver 6 with these data bits.

Figure 7:
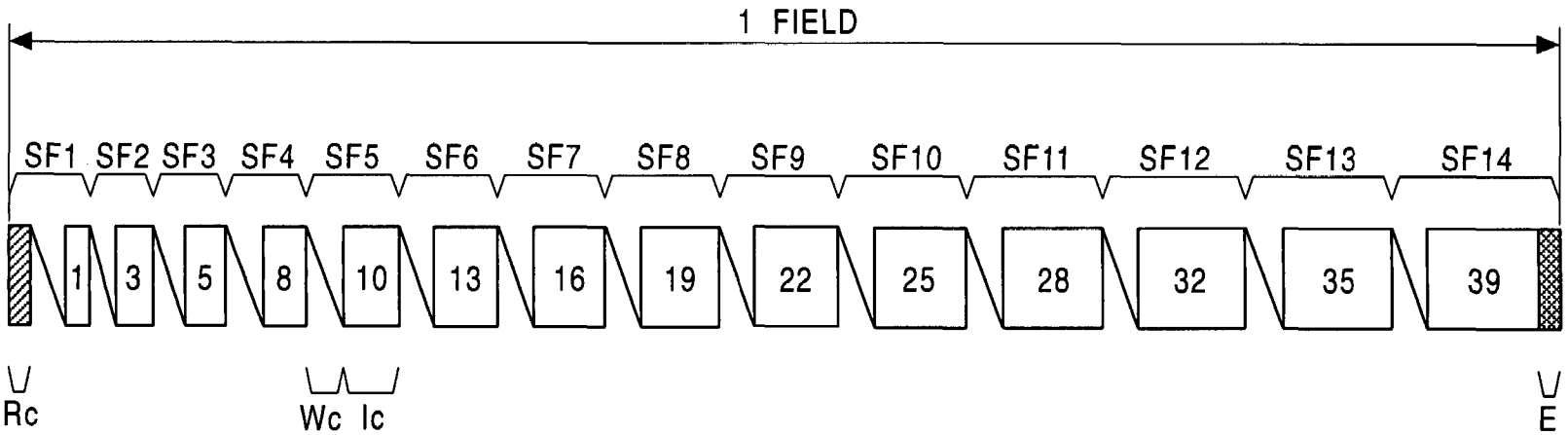
FIG. 7 is a drawing for showing an example of a light emission drive format when a PDP 10 is driven for a grayscale representation.

The drive control circuit 2 supplies the address driver 6, the first sustain driver 7, and the second sustain driver 8 with different types of timing signals for driving and controlling the PDP 10 based on a light emission drive format shown in FIG. 7.

The display period of each field (hereafter, it is assumed that expression of "field" covers one frame as well) is divided into fourteen subfields SF1 to SF14 in the light emission drive format shown in FIG. 7. The subfields respectively include the address period $W_C$ for setting each of the discharge cells in the PDP 10 to either one of a "light-on discharge cell state" and a "light-off discharge cell state", and a light emission sustain period $I_C$ for turning on only the discharge cells in the "light-on discharge cell state" for a preselected number of times equal to or proportional to each of the numbers described in FIG. 7. Only the first subfield SF1 has a simultaneous reset period $R_C$ for initializing a wall charge quantity in the entire discharge cells in the PDP 10, and the last subfield SF14 has an erase period E for simultaneously erasing the wall charges in the entire discharge cells.

Figure 8:
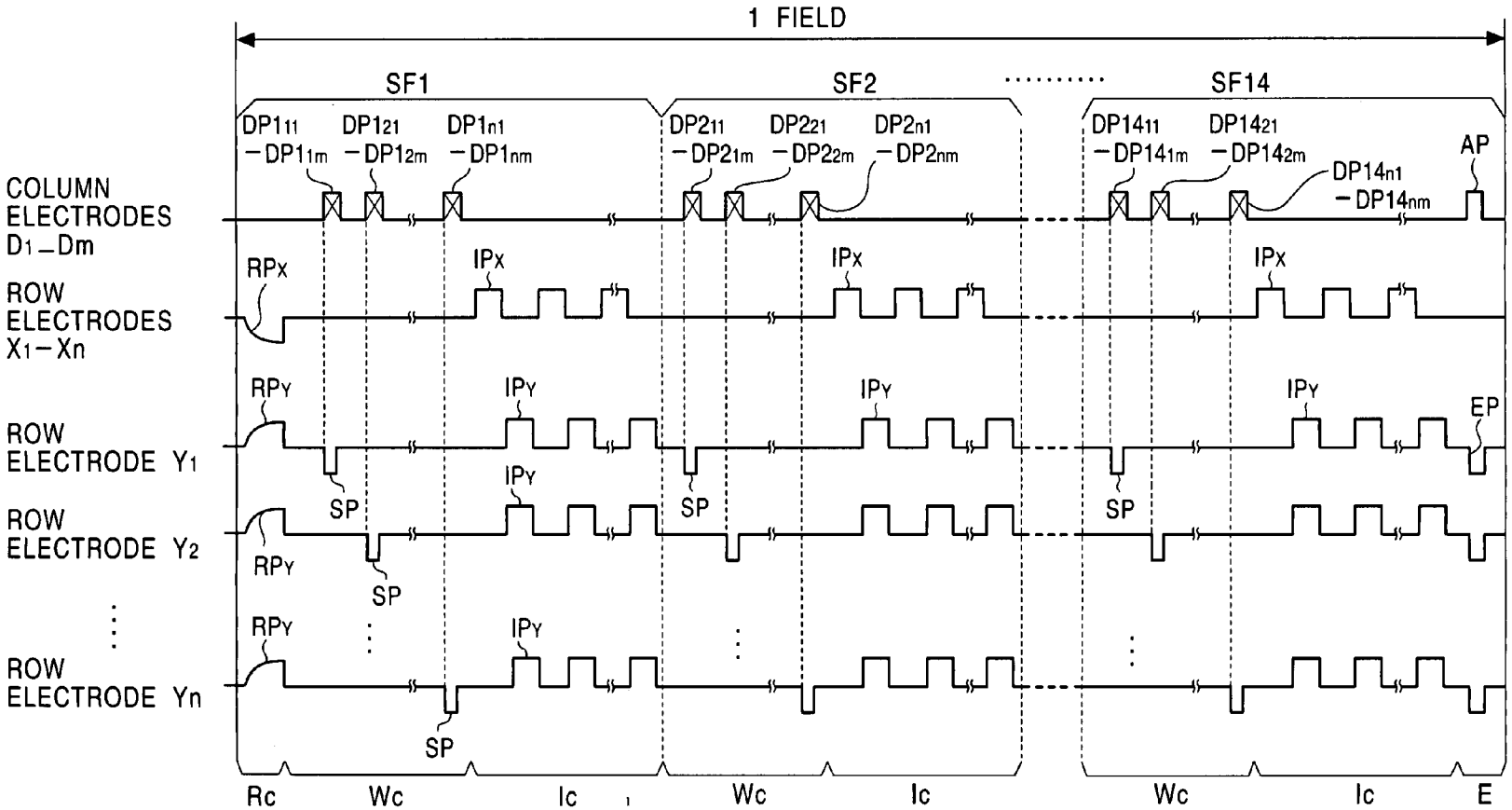
FIG. 8 is a drawing for showing different types of drive pulses impressed on the PDP 10 based on the light emission drive format shown in FIG. 7, and their impressing timings.

FIG. 8 is a drawing for showing different types of drive pulses impressed on the PDP 10 respectively by the address driver 6, the first sustain driver 7, and the second sustain driver 8, and their impressing timings in the simultaneous reset period $R_C$, the address period $W_C$, the light emission sustain period $I_C$, and the erase period E.

The first sustain driver 7 and the second sustain driver 8 respectively impress reset pulses $RP_X$ and $RP_Y$ having waveforms shown in FIG. 8 on the row electrodes $X_1$ to $X_n$ and $Y_1$ to $Y_n$ simultaneously in the simultaneous reset period $R_C$ which only exists in the subfield SF1. When these reset pulses $PR_X$ and $PR_Y$ are impressed simultaneously, the entire discharge cells are discharged and reset in the PDP 10, and a predetermined amount of wall charge is formed uniformly in each of the discharge cells immediately after the reset discharge. This reset discharge initializes the entire discharge cells to the "light-on discharge cell state".

Then, the address driver 6 generates pixel data pulses having voltages corresponding to the logic levels of the pixel drive data bits DB supplied from the memory 4 in the address period $W_C$ in each of the subfields. For example, the address driver 6 generates the pixel data pulse at a high voltage when the logic level of the pixel drive data bit DB is "1", and generates the pixel data pulse at a low voltage (0 volt) when the logic level of the pixel drive data bit DB is "0". In this process, the address driver 6 repeats to impress the pixel data pulses (number (m)) generated as described above line by line on the column electrodes $D_1$ to $D_m$. For example, because the memory 4 supplies the pixel drive data bits $DB1_{11}$ to $DB1_{nm}$, the address driver 6 first extracts data bits corresponding to the first line, namely $DB1_{11}$ to $DB1_{1m}$, in the address period $W_C$ of the subfield SF1. Then, the address driver 6 converts m pixel drive data bits $DB1_{11}$ to $DB1_{1m}$ into m pixel data pulses $DP1_{11}$ to $DP1_{1m}$ corresponding to the logic level of the pixel drive data bits, and simultaneously impresses these pixel data pulses on the column electrodes $D_1$ to $D_m$ as shown in FIG. 8. In the next step, the address driver 6 extracts data bits $DB1_{21}$ to $DB1_{2m}$ corresponding to the second line from the pixel drive data bit groups $DB1_{11}$ to $DB1_{nm}$. Then, the address driver 6 converts m pixel drive data bits $DB1_{21}$ to $DB1_{2m}$ into m pixel data pulses $DP1_{21}$ to $DP1_{2m}$ corresponding to the logic level of the pixel drive data bits, and simultaneously impresses these pixel data pulses on the column electrodes $D_1$ to $D_m$ as shown in FIG. 8. In the same way, the address driver 6 supplies the pixel data pulses DP1 corresponding to the pixel drive data bits DB1 supplied from the memory 4 line by line to the column electrodes $D_1$ to $D_m$ in the address period $W_C$ of the subfield SF1.

Further, the second sustain driver 8 generates scan pulses SP having the negative polarity at the timing of supplying the pixel data pulses DP line by line as shown in FIG. 8 in the address period $W_C$, and sequentially supplies these pulses to the row electrodes $Y_1$ to $Y_n$. In this process, a discharge (a selective erase discharge) is generated only in the discharge cells at intersections of the column electrodes to which the scan pulse SP is supplied, and the row electrodes to which the pixel data pulses at the high voltage is supplied, and the wall charge remaining in the discharge cell is selectively erased. This selective erase discharge sets the discharge cells which were initialized to the "light-on discharge cell state" in the simultaneous reset period $R_C$ to the "light-off discharge cell state". On the other hand, the discharge cells in which the selective erase discharge is not generated maintain the state immediately before. Namely, the discharge cells in the "light-on discharge state" remains set to the "light-on discharge cell state", and the discharge cells in the "light-off discharge cell state" remains set to the "light-off discharge cell state".

The first sustain driver 7 and the second sustain driver 8 respectively supply sustain pulses $IP_X$ and $IP_Y$ with positive polarity alternately to the row electrodes $X_1$ to $X_n$ and $Y_1$ to $Y_n$ in the light emission sustain period $I_C$ in each of the subfields as shown in FIG. 8. The number for repeating the supply of the sustain pulse IP in the light emission sustain period $I_C$ in each of the subfields SF1 to SF14 is determined in advance according to a weight of the subfield. If the number is "1" in SF1, the following numbers of the pulses are supplied in the subfields as shown in FIG. 7.

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

Only the discharge cells having the remaining wall charge, namely the discharge cells set to the "light-on discharge cell state" in the address period $W_C$, are discharged for sustaining every time the sustain pulses $IP_X$ and $IP_Y$ are supplied, and sustain the light emission state caused by the sustain discharge during the number of the discharges assigned to each of the subfields. The pixel drive data GD corresponding to the luminance level of each of the pixels represented by the input video signal determines whether each of the discharge cells is set to the "light-on discharge cell state" or not in the address period $W_C$. There are 15 possible patterns as the pixel drive data GD as shown in FIG. 6.

The logic level of the first bit of the pixel drive data GD is always "0" except for the one corresponding to the grayscale pixel data $PD_S$ representing the lowest luminance "0000" as shown in FIG. 6. After the first bit, the successive bits of the number corresponding to the luminance level to be expressed are the logic level of "0", and then successive three bits (or successive bits to the end of the field) of logic level "1" follow. In the subsequent bits, the odd bits, namely the fifth, seventh, ninth, and eleventh bits always have the logic level "1", and the even bits have the logic level "0". Namely, after three successive bits of the logic level "1", the logic level "1" appears at every other bit.

In this process, when the pixel drive data GD is at the logic level of "1", the selective erase discharge is generated in the address period $W_c$ in the subfield corresponding to that bit, and the discharge cell is set to the "light-off discharge cell state". On the other hand, when the pixel drive data GD is at the logic level of "0", the selective erase discharge is not generated in the address period $W_C$ in the subfield corresponding to that bit, and the discharge cell maintains the last state.

With the driving method shown in FIG. 7, only the simultaneous reset period $R_C$ in the first subfield SF1 forms the wall charge in the discharge cell, and resets this discharge cell from the "light-off discharge cell state" to the "light-on discharge cell state". Therefore, with the drive using the pixel drive data GD in FIG. 6, the discharge cell is maintained in the "light-on discharge cell state" from the start of each field until the selective erase discharge is generated in the address period $W_c$ of the subfield as indicated with a black circle in FIG. 6. Once the selective erase discharge is generated, the discharge cell is maintained in the "light-off discharge cell state" from that point, and never returns to the "light-on discharge cell state" until the end of the field. Thus, each of the discharge cells is maintained in the "light-on discharge cell state" until the selective erase discharge is generated for the first time in each field, and the sustain discharge is successively generated in the light emission sustain periods $I_C$ in each of the subfields (indicated by white circles) existing before this selective erase discharge.

Thus, when the pixel drive data GD shown in FIG. 6 are used for conducting the drive based on the light emission drive format shown in FIG. 7, it is possible to represent the intermediate luminance in the 15 grayscale levels respectively having the different degrees of visual luminance of 0, 1, 4, 9, 17, 27, 40, 56, 75, 97, 122, 150, 182, 217, and 255, and each of these levels corresponds to the total number of the sustain discharge light emissions generated in each of the light emission sustain periods $I_C$ from SF1 to SF14.

In this driving method, there are no patterns whose light emission period (indicated by the white circles in FIG. 6) and the light-off period are inversed to each other in one field as shown in FIG. 6. Namely, the first part is always the light emission period, and the second part is always the light-off period in one field, and no such a pattern as the first part is light-off period, and the second part is the light emission period is mixed in the drive using the pixel drive data GD shown in FIG. 6. Thus, when one moves the line of sight while viewing the screen in a period of the one field, one does not visually recognize only successive light-off periods (or successive light emission periods), and the false contour described before does not occur.

With the driving method shown in FIG. 7, when the selective erase discharge is normally generated once, this selective erase discharge maintains the discharge cell in the "light-off discharge cell state" until the end of one field. However, if the amount of charged particles formed by the discharge is small in the discharge cell, even if the pixel data pulse and the scan pulse SP at high voltages are supplied to the discharge cell, the selective erase discharge is not generated normally, and the entire wall charge is not erased completely. As a result, the discharge cell which should be in the "light-off discharge cell state" is set to the "light-on discharge cell state", to cause degrading of the display quality.

With the driving method using the pixel drive data GD shown in FIG. 6, the first selective erase discharge is generated in one subfield according to the luminance level of an image represented by the input video signal, and then, the selective erase discharge is repeated respectively in the following two subfields (or the subfields to the end of the field). Thus, even if the first selective erase discharge fails, and does not erase the entire wall charge in the discharge cell, the second and the additional third selective erase discharges erase the wall charge, and the degraded display caused by a failed discharge is restrained.

With the driving method using the pixel drive data GD shown in FIG. 6, after the selective erase discharge is generated respectively in three successive subfields (or the subfields to the end of the field) as described above, the selective erase discharge is generated to erase wall charge formed again in the discharge cell only in the following odd subfields. Thus, even if an influence of the discharge in the neighboring discharge cells forms wall charge again in the discharge cell which should be in the "light-off discharge cell state", for example, the selective erase discharge generated in the every odd subfield erases the wall charge. Thus, it is possible to prevent a false sustain discharge light emission caused by a transition of the discharge cell which should be in the "light-off discharge cell state" to the "light-on discharge cell state".

With the driving method using the pixel drive data GD shown in FIG. 6, the first selective erase discharge is generated in one subfield according to the luminance level of an image represented by the input video signal, and then, the selective erase discharge is generated only in the odd subfields for erasing the wall charge formed again. Thus, a power consumption caused by the discharge is restrained compared with the conventional drive where the discharge is generated not only in the odd subfields but also in the even subfields as shown in FIG. 2. Further, as described above, the selective erase discharge for erasing the wall charge formed again is simultaneously generated with the timing of the odd subfield. It is possible to restrain a power consumption due to a current flow caused by an electric potential generated when the discharge cells where a discharge is generated and the discharge cells where a discharge is not generated exist simultaneously.

While the selective erase discharge for erasing the wall charge formed again is generated only in the odd subfields in the embodiment shown in FIG. 6, the selective erase discharge may be generated only in the even subfields.

FIG. 9 is a drawing for showing a conversion table used in the second data conversion circuit 34, and a light emission drive pattern when the selective erase discharge is generated only in the even subfields for erasing the wall charge formed again.

While the selective erase discharge is generated only in the odd (or even) subfields for erasing the wall charge formed again in the embodiment above, the selective erase discharge may be generated in the successive subfields.

FIG. 10 is a drawing for showing a conversion table used in the second data conversion circuit 34, and a light emission drive pattern when the selective erase discharge for erasing the wall charge formed again is repeatedly generated in two successive subfields (SF7 and SF8, SF10 and SF11, and SF13 and SF14).

While the selective erase discharge for erasing the wall charge formed again is generated in the subfield(s) separated by one subfield in the embodiments shown in FIG. 6, FIG. 9. and FIG. 10, the selective erase discharge may be generated in the subfields separated by a plurality of subfields.

FIG. 11 is a drawing for showing a conversion table used in the second data conversion circuit 34, and a light emission drive pattern when the selective erase discharge for erasing the wall charge formed again is generated in every three subfields.

With the driving methods shown in FIG. 9 to FIG. 11, the selective erase discharge is repeatedly generated respectively in one subfield according to the luminance level of an image represented by the input video signal, and in the following two subfields, and then, the selective erase discharge is generated for erasing the wall charge formed again in the same way as the drive shown in FIG. 6.

While the selective erase discharge for erasing the wall charge formed again is generated intermittently for a plurality of times in the embodiments shown in FIG. 6, and FIG. 9 to FIG. 11, the discharge may be generated once.

Namely, after the first selective erase discharge is generated in one subfield according to the luminance level of an image represented by the input video signal, the selective erase discharge is generated only in the predetermined subfield(s) out of the following subfields for erasing the wall charge formed again.

As detailed above, the state (light-on or light-off) of the discharge cell is set only in one subfield out of the N subfields constituting each field for providing (N+1)-level grayscale display in the present invention. After the selective discharge for this setting is generated, the selective discharge is repeatedly generated at the predetermined subfields.

With this driving method, because there are no two patterns whose relationships between the light emission period and light-off period are inversed to each other, the generation of a false contour is restrained. Even if wall charge is formed again in a discharge cell which is assumed to be in the light-off state by the influence from the discharges in neighboring discharge cells, because the selective discharges in the subfields at the predetermined positions erase the wall charge, it is possible to restrain the degradation of the image quality caused by the wrong sustain discharge light emission with a relatively small amount of power consumption. Further, because the selective discharge is simultaneously generated in the subfields at the predetermined positions for erasing the wall charge formed again, it is possible to restrain a power consumption corresponding to a current flow caused by an electric potential generated when the discharge cells where a discharge is generated and the discharge cells where a discharge is not generated exist simultaneously.

Thus, the method for driving a plasma display panel of the present invention realizes a high quality image display with low power consumption while restraining generation of a false contour.

This application is based on Japanese Patent Application No. 2001-205532 which is herein incorporated by reference.

What is claimed is:

1. A driving method for a plasma display panel having discharge cells serving as pixels formed at respective intersections between a plurality of row electrodes corresponding to display lines, and a plurality of column electrodes arranged across said row electrodes, in which a field of a video signal is constituted by N subfields, and said plasma display panel is driven subfield by subfield such that subfields in each field of which the number is set according to a grayscale level to be displayed are continuously driven to emit light, wherein each of said subfields comprising:

an address period for generating a selective erase discharge in each of said discharge cells to set said each of said discharge cells to either one of a light-on discharge cell state and a light-off discharge cell state; and a light emission sustain period for repeating a sustain discharge only in said discharge cells in said light-on discharge cell state for a number of times corresponding to a weight of said subfield, wherein selective erase discharges for one discharge cell comprises a first selective erase discharge executed in the address period of one subfield of said N subfields, and second selective erase discharges respectively executed in the address periods of subfields after said one subfield, said one discharge cell is driven to emit light successively in the light emission sustain periods of subfields from the head subfield to a subfield just before said one sub-field in which said first selective erase discharge is executed, and said second selective erase discharges, excluding those executed in L successive subfields after said one subfield in which said first selective erase discharge is executed, are executed only in address periods of M ($M<N-L-1$) subfields at predetermined positions from the head subfield, for all of grayscale levels from the lowest grayscale level to each of the grayscale levels;

wherein $L>2$.

2. The driving method for a plasma display panel according to claim 1, wherein said subfields at said predetermined positions follow said one subfield, and are arranged at odd number positions in each field.

3. The driving method for a plasma display panel according to claim 1, wherein said subfields at said predetermined positions follow said one subfield, and are arranged at even number positions in each field.

4. The driving method for a plasma display panel according to claim 1, wherein said subfield placed at the head of each of the fields further comprises a reset period for generating a reset discharge in said entire discharge cells before said address period to initialize said discharge cells to either one of said light-on discharge cell state and said light-off discharge cell state.

5. A driving method for a plasma display panel having discharge cells serving as pixels formed at intersections between a plurality of row electrodes corresponding to display lines, and a plurality of column electrodes arranged across said row electrodes, in which a field of a video signal is constituted by N subfields, and said plasma display panel is driven subfield by subfield such that subfields in each field of which the number is set according to a grayscale level to be displayed are continuously driven to emit light, wherein each of said subfields comprising:

an address period for generating a selective erase discharge in each of said discharge cells to set said each of said discharge cells to either one of a light-on discharge cell state and a light-off discharge cell state; and a light emission sustain period for repeating a sustain discharge only in said discharge cells in said light-on discharge cell state for a number of times corresponding to a weight of said subfield, wherein selective erase discharges for one discharge cell comprises a first selective erase discharge executed in the address period of one subfield of said N subfields, and second selective erase discharges respectively executed in the address periods of subfields after said one subfield, said one discharge cell is driven to emit light successively in the light emission sustain periods of subfields from the head subfield to a subfield just before said one sub-field in which said first selective erase discharge is executed, and said second selective erase discharges, excluding those executed in L successive subfields after said one subfield in which said first selective erase discharge is executed, are executed only in address periods of M ($M<N-L-1$) subfields at predetermined positions from the head subfield, for all of grayscale levels from the lowest grayscale level to each of the grayscale levels;

wherein $L>2$.

6. The driving method for a plasma display panel according to claim 5, wherein said subfield placed at the start of each field further comprises a reset period for generating a reset discharge in said entire discharge cells before said address period to initialize said discharge cells to either one of said light-on discharge cell state and said light-off discharge cell state.

7. A driving method for a plasma display panel including discharge cells serving as pixels formed at intersections between a plurality of row electrodes corresponding to display lines, and a plurality of column electrodes arranged across said row electrodes, in which a field of a video signal is constituted by N subfields, and said plasma display panel is driven subfield by subfield such that subfields in each field which correspond in number to a grayscale level to be displayed are continuously driven to emit light, wherein each of said subfields comprising:

an address period for generating a selective erase discharge in each of said discharge cells to set said each of said discharge cells to either one of a light-on discharge cell state and a light-off discharge cell state; and a light emission sustain period for repeating a sustain discharge only in said discharge cells in said light-on discharge cell state for a number of times corresponding to a weight of said subfield, said selective erase discharge is repeatedly generated in said address period of one subfield of said N subfields and the following L successive subfields, and then said selective erase discharge is generated additionally only in address periods respectively of subfields placed at predetermined positions from a head of each field, and subfields respectively following said subfields placed at predetermined positions from the head of each field;

wherein $L>2$.

8. A driving method for a plasma display panel including discharge cells for serving as pixels formed at intersections between a plurality of row electrodes corresponding to display lines, and a plurality of column electrodes arranged across said row electrodes, in which a field of a video signal is constituted by N subfields, and said plasma display panel is driven subfield by subfield such that subfields in each field of which the number is set according to a grayscale level to be displayed are continuously driven to emit light, wherein each of said subfields comprising:

an address period for generating a selective erase discharge in each of said discharge cells to set said each of said discharge cells to either one of a light-on discharge cell state and a light-off discharge cell state; and a light emission sustain period for repeating a sustain discharge only in said discharge cells in said light-on discharge cell state for a number of times corresponding to a weight of said subfield, wherein selective erase discharges for one discharge cell comprises a first selective erase discharge executed in the address period of one subfield of said N subfields, and second selective erase discharges respectively executed in the address periods of subfields after said one subfield, said one discharge cell is driven to emit light successively in the light emission sustain periods of subfields from the head subfield to a subfield just before said one sub-field in which said first selective erase discharge is executed, and said second selective erase discharges, excluding those executed in L successive subfields after said one subfield in which said first selective erase discharge is executed, are executed only in address periods of M ($M<N-L-1$) subfields at every other positions, for all of grayscale levels from the lowest grayscale level to each of the grayscale levels;

wherein $L>2$.

9. The driving method for a plasma display panel according to claim 8, wherein said subfield placed at the head of each field further comprises a reset period for generating a reset discharge in said entire discharge cells before said address period to initialize said discharge cells to either one of said light-on discharge cell state and said light-off discharge cell state.

* * * * *